US010706870B2

(12) United States Patent
Matsuo

(10) Patent No.: US 10,706,870 B2
(45) Date of Patent: Jul. 7, 2020

(54) SOUND PROCESSING METHOD, APPARATUS FOR SOUND PROCESSING, AND NON-TRANSITORY COMPUTER-READABLE STORAGE MEDIUM

(71) Applicant: FUJITSU LIMITED, Kawasaki-shi, Kanagawa (JP)

(72) Inventor: Naoshi Matsuo, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 128 days.

(21) Appl. No.: 16/163,780

(22) Filed: Oct. 18, 2018

(65) Prior Publication Data

US 2019/0122688 A1 Apr. 25, 2019

(30) Foreign Application Priority Data

Oct. 23, 2017 (JP) ..... 2017-204488

(51) Int. Cl.

| | |
|---|---|
| ***G10L 21/00*** | (2013.01) |
| ***G10L 21/0232*** | (2013.01) |
| ***H04R 1/40*** | (2006.01) |
| ***G10L 21/0224*** | (2013.01) |
| ***H04R 5/04*** | (2006.01) |
| *G10L 21/0216* | (2013.01) |

(52) U.S. Cl.

CPC ..... *G10L 21/0232* (2013.01); *G10L 21/0224* (2013.01); *H04R 1/406* (2013.01); *H04R 5/04* (2013.01); *G10L 2021/02166* (2013.01); *H04R 2410/05* (2013.01)

(58) Field of Classification Search

CPC ..... G10L 21/00

USPC ..... 704/278, 271, 233, 226, 205, 204; 455/570; 381/94.3, 92, 73.1, 71.8, 56

See application file for complete search history.

(56) References Cited

U.S. PATENT DOCUMENTS

| | | | | |
|---|---|---|---|---|
| 7,357,513 | B2 * | 4/2008 | Watson | H01S 5/141 353/31 |
| 10,441,185 | B2 * | 10/2019 | Rogers | A61B 5/04085 |
| 2003/0014248 | A1 * | 1/2003 | Vetter | G10L 21/0208 704/226 |
| 2004/0138874 | A1 * | 7/2004 | Kaajas | G10L 21/038 704/205 |
| 2006/0212298 | A1 * | 9/2006 | Kemmochi | G10H 5/005 704/278 |
| 2007/0274536 | A1 * | 11/2007 | Matsuo | H04R 3/04 381/94.3 |
| 2008/0040101 | A1 * | 2/2008 | Hayakawa | H04R 3/005 704/203 |
| 2008/0167869 | A1 * | 7/2008 | Nakadai | G10L 15/20 704/233 |
| 2009/0285409 | A1 * | 11/2009 | Yoshizawa | G01S 3/8083 381/92 |

(Continued)

FOREIGN PATENT DOCUMENTS

| | | |
|---|---|---|
| JP | 2007-318528 | 12/2007 |
| JP | 2008-064733 | 3/2008 |

*Primary Examiner* — Michael Colucci

(74) *Attorney, Agent, or Firm* — Fujitsu Patent Center

(57) ABSTRACT

A sound processing method includes: executing a time frequency conversion process; executing a noise level evaluation process; executing a bandwidth controlling process; executing a sound source direction decision process; executing a gain setting process; executing a correction process; and executing a frequency time conversion process.

15 Claims, 13 Drawing Sheets

(56) References Cited

U.S. PATENT DOCUMENTS

| | | | | |
|---|---|---|---|---|
| 2009/0323977 | A1* | 12/2009 | Kobayashi | H04R 1/406<br>381/71.8 |
| 2010/0056227 | A1* | 3/2010 | Hayakawa | G10L 21/0208<br>455/570 |
| 2012/0095755 | A1* | 4/2012 | Otani | G10L 25/00<br>704/205 |
| 2012/0212375 | A1* | 8/2012 | Depree, IV | H01Q 15/0086<br>343/700 MS |
| 2013/0339025 | A1* | 12/2013 | Suhami | H04R 25/00<br>704/271 |
| 2015/0117652 | A1* | 4/2015 | Sato | G10L 25/78<br>381/56 |
| 2015/0194144 | A1* | 7/2015 | Park | H04K 3/41<br>381/73.1 |
| 2016/0064012 | A1* | 3/2016 | Endo | H04R 3/005<br>704/205 |

* cited by examiner

SOUND PROCESSING METHOD, APPARATUS FOR SOUND PROCESSING, AND NON-TRANSITORY COMPUTER-READABLE STORAGE MEDIUM

CROSS-REFERENCE TO RELATED APPLICATIONS

This application is based upon and claims the benefit of priority of the prior Japanese Patent Application No. 2017-204488, filed on Oct. 23, 2017, the entire contents of which are incorporated herein by reference.

FIELD

The embodiment discussed herein relates to a sound processing method, an apparatus for sound processing, and non-transitory computer-readable storage medium for storing a sound processing program that causes a processor to process a sound signal including sound collected, for example, using a plurality of microphones.

BACKGROUND

In recent years, a sound processing apparatus has been developed which processes a sound signal obtained by collecting sound using a plurality of microphones. In such a sound processing apparatus as just described, a technology for suppressing sound from any other direction than a specific direction in a sound signal in order to make it easy to hear sound from the specific direction in the sound signal is being investigated.

Examples of the related art include Japanese Laid-open Patent Publication No. 2007-318528.

SUMMARY

According to an aspect of the embodiments, a sound processing method performed by a computer includes: executing a time frequency conversion process that includes converting a first sound signal acquired from a first sound inputting apparatus and a second sound signal acquired from a second sound inputting apparatus disposed at a position different from that of the first sound inputting apparatus into a first frequency spectrum and a second frequency spectrum in a frequency domain for each of frames having a given time length, respectively; executing a noise level evaluation process that includes calculating, for each of the frames, one of power of noise and a signal to noise ratio based on one of the first frequency spectrum and the second frequency spectrum; executing a bandwidth controlling process that includes setting, for each of the frames, a width of a frequency band in response to the one of the power of noise and the signal to noise ratio; executing a sound source direction decision process that includes comparing, for each of the frames and for each of frequency bands having the width, first power of a frequency component, which is included in the frequency band of one of the first frequency spectrum and the second frequency spectrum, of sound coming from a first direction and second power of a frequency component, which is included in the frequency band of one of the first frequency spectrum and the second frequency spectrum, of sound coming from a second direction different from the first direction with each other; executing a gain setting process that includes setting a gain according to a result of the comparison for each of the frames and for each of the frequency bands; executing a correction process that includes calculating, for each of the frames and for each of the frequency bands, a frequency spectrum corrected by multiplying a frequency component included in the frequency band of one of the first frequency spectrum and the second frequency spectrum by the gain set for the frequency band; and executing a frequency time conversion process that includes generating a directional sound signal by frequency time converting the corrected frequency spectrum for each of the frames.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In the related art, it is decided for each frequency whether or not a component of the frequency included in a sound signal is a component included in sound coming from a specific direction. Therefore, the technology fails to control for each frequency whether or not the component of the frequency is to be suppressed.

However, the strength of a frequency component included in sound differs among different frequencies. Therefore, depending upon a frequency, a component of the frequency included in noise that comes from a direction other than a specific direction is sometimes greater than a component of the frequency included in sound coming from the specific direction. In such a case as just described, in the technology described above, a component of sound coming from a specific direction is sometimes suppressed in a frequency at which a component included in noise is greater than a component included in sound coming from the specific direction. As a result, sound coming from the specific direction is sometimes distorted in the sound signal after such suppression.

According to one aspect of the present disclosure, a technology for sound processing capable of suppressing excessive suppression of sound coming from a specific direction is provided.

In the following, a sound processing apparatus is described with reference to the drawings. The sound processing apparatus analyzes and suppresses, for each frequency, sound coming from any other direction than a specific direction in which a noticed sound source is positioned in sound signals obtained from a plurality of sound inputting units. However, the strength of a frequency component included in sound differs among different frequencies as described above. Therefore, depending upon a frequency, a component of the frequency included in noise that comes from a direction other than a specific direction is sometimes greater than a component of the frequency included in sound coming from the specific direction.

Figure 1:
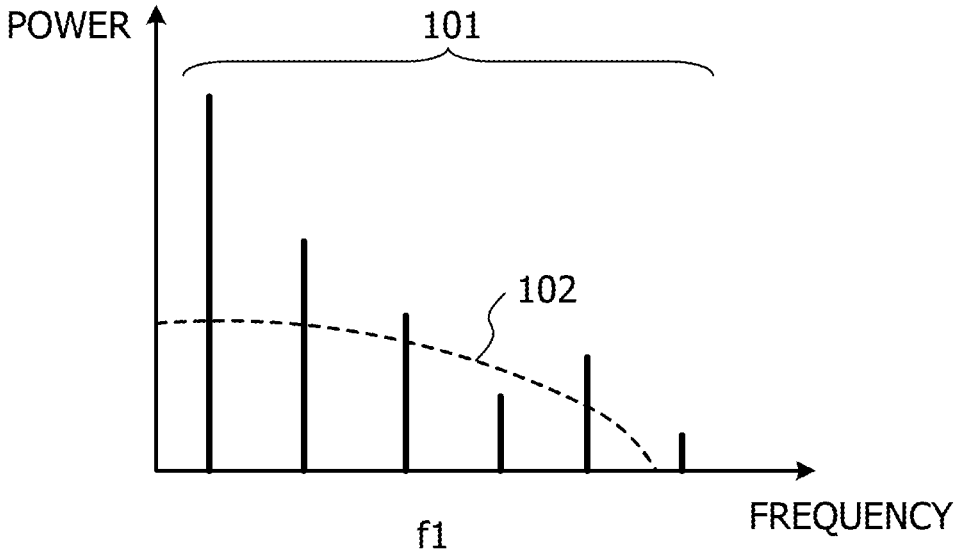
FIG. 1 depicts an example of a relationship in magnitude between components for individual frequencies included in sound arriving from a specific direction and components for individual frequencies included in noise.

FIG. 1 depicts an example of a relationship in magnitude between a component for each frequency included in sound coming from a specific direction and a component for each frequency included in noise. Referring to FIG. 1, the axis of abscissa represents the frequency and the axis of ordinate represents the power of a frequency component. A profile 101 represented as a set of bar graphs represents the power for each frequency component included in sound coming from a specific direction. Meanwhile, a profile 102 represented by a broken line represents the power for each frequency component included in noise. As indicated by the profile 101, the power differs among different frequency components included in sound coming from the specific direction. For example, it is known that human voice pitches, in the frequency domain, the strong and weak based on a frequency characteristic of the vocal tract (from the vocal cords to the mouth). Therefore, depending upon a frequency, the power of a frequency component becomes low. As a result, a frequency sometimes exists at which, even when sound comes from a specific direction, the power of a frequency component included in noise is higher than the power of a frequency component included in the sound like, for example, a frequency f1 in FIG. 1. Especially, it is supposed that, as the power of noise increases, the number of frequencies at which the power of a frequency component included in noise is higher than the power of a frequency component included in sound coming from the specific direction increases.

Therefore, the present sound processing apparatus decides a coming direction of noise and increases, as the noise level increases, the width of a frequency band to be made a unit for setting of a gain. Consequently, even if the frequency band includes a frequency at which the power of a frequency component is higher in noise than in sound coming from the specific direction, if the power of the sound coming from the specific direction is higher than the power of the noise over the overall frequency band, the sound signal is not suppressed. Therefore, the sound processing apparatus may suppress excessive suppression of the sound coming from the specific direction.

Figure 2:
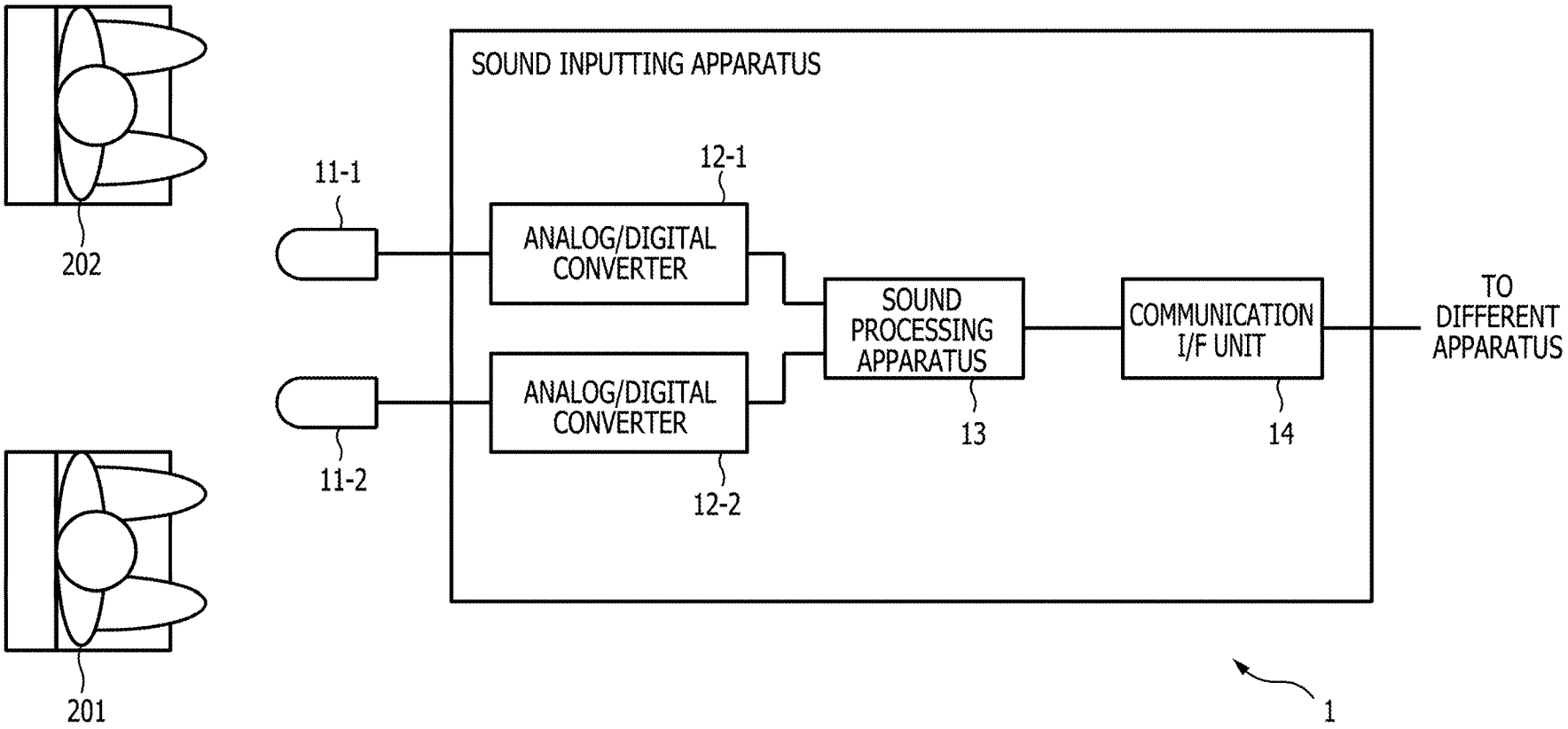
FIG. 2 depicts a schematic configuration of a sound inputting apparatus in which a sound processing apparatus according to one embodiment is incorporated.

FIG. 2 depicts a schematic configuration of a sound inputting apparatus in which a sound processing apparatus according to one embodiment is incorporated. The sound inputting apparatus 1 includes two microphones 11-1 and 11-2, two analog/digital converters 12-1 and 12-2, a sound processing apparatus 13, and a communication interface unit 14. The sound inputting apparatus 1 is incorporated, for example, in a vehicle (not depicted).

Each of the microphones 11-1 and 11-2 is an example of a sound inputting unit. The microphone 11-1 and the microphone 11-2 are disposed in the proximity of, for example, the instrument panel or the ceiling in the cabin between a driver 201 who is a sound source to be made a sound collection target and a passenger 202 whose is on a passenger's seat to be made a different sound source. It is to be noted that, in the following description, the passenger on the passenger's seat is merely referred to as passenger. In the present example, the microphone 11-1 and the microphone 11-2 are disposed such that the microphone 11-1 is positioned nearer to the passenger 202 than the microphone 11-2 and the microphone 11-2 is positioned nearer to the driver 201 than the microphone 11-1. The microphone 11-1 collects surrounding sound to generate an analog input sound signal, which is inputted to the analog/digital converter 12-1. Similarly, the microphone 11-2 collects surrounding sound to generate an analog input sound signal, which is inputted to the analog/digital converter 12-2.

The analog/digital converter 12-1 samples the analog input sound signal received from the microphone 11-1 with a given sampling frequency to generate a digitalized input sound signal. Similarly, the analog/digital converter 12-2 samples the analog input sound signal received from the microphone 11-2 with the given sampling frequency to generate a digitalized input sound signal.

It is to be noted that, in the following description, an input sound signal generated by sound collection by the microphone 11-1 and digitalized by the analog/digital converter 12-1 is referred to as first input sound signal for the convenience of description. Further, an input sound signal generated by sound collection by the microphone 11-2 and digitalized by the analog/digital converter 12-2 is referred to as second input sound signal.

The analog/digital converter 12-1 outputs the first input sound signal to the sound processing apparatus 13. Similarly, the analog/digital converter 12-2 outputs the second input sound signal to the sound processing apparatus 13.

The sound processing apparatus 13 includes, for example, one or a plurality of processors and a memory. The sound processing apparatus 13 generates, from the received first input sound signal and second input sound signal, a directional sound signal in which noise coming from the other directions than a first direction (in the present embodiment, in a direction in which the driver 201 is positioned). Then, the sound processing apparatus 13 outputs the directional sound signal to a different apparatus such as a navigation system (not depicted) or a hands-free phone (not depicted) through the communication interface unit 14.

The communication interface unit 14 includes a communication interface circuit for coupling the sound inputting apparatus 1 to a different apparatus in accordance with a given communication standard or a like circuit. For example, the communication information circuit may be a circuit that operates in accordance with a near field wireless communication standard utilizable for communication of a sound signal such as, for example, Bluetooth (registered trademark) or a circuit that operates in accordance with a serial bus standard such as the universal serial bus (USB)

standard. The communication interface unit 14 outputs the directional sound signal received from the sound processing apparatus 13 to a different apparatus.

Figure 3:
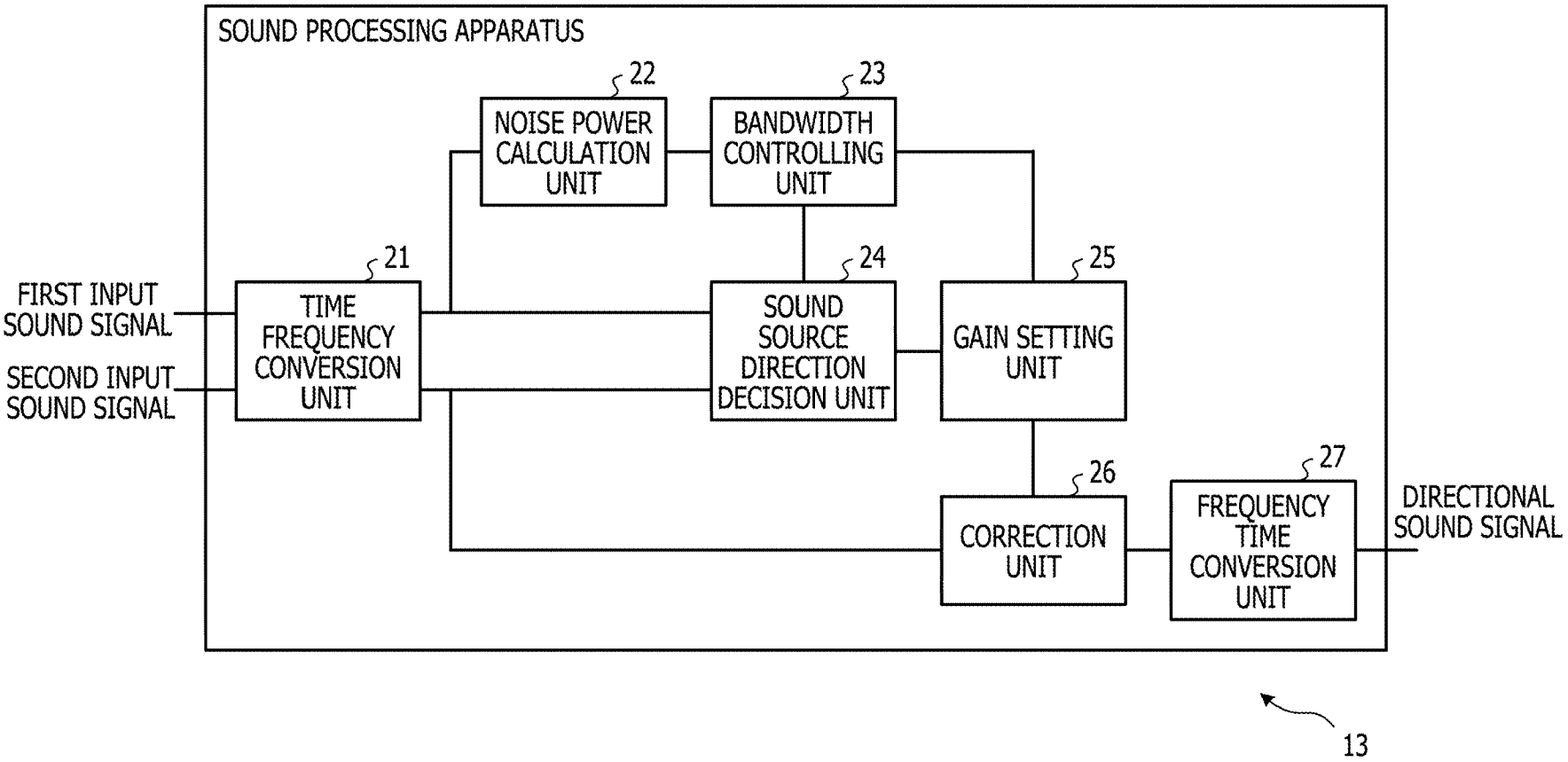
FIG. 3 depicts a schematic configuration of a sound processing apparatus according to one embodiment.

FIG. 3 depicts a schematic configuration of a sound processing apparatus according to one embodiment. The sound processing apparatus in FIG. 3 may be the sound processing apparatus 13 depicted in FIG. 2. The sound processing apparatus 13 includes a time frequency conversion unit 21, a noise power calculation unit 22, a bandwidth controlling unit 23, a sound source direction decision unit 24, a gain setting unit 25, a correction unit 26 and a frequency time conversion unit 27. The components of the sound processing apparatus 13 are incorporated as function modules implemented by a computer program executed by a processor, for example, the sound processing apparatus 13 includes. Alternatively, the components the sound processing apparatus 13 includes may be incorporated as one or a plurality of integrated circuits for implementing functions of the components separately from the processor the sound processing apparatus 13 includes in the sound processing apparatus 13.

The time frequency conversion unit 21 converts the first input sound signal and the second input sound signal from those in the time domain into those in the frequency domain in a unit of a frame to calculate a frequency spectrum including an amplitude component and a phase component for each of a plurality of frequencies. It is to be noted that, since the time frequency conversion unit 21 may perform a same process for the first input sound signal and the second input sound signal, in the following description, the process for the first input sound signal is described.

In the present embodiment, the time frequency conversion unit 21 divides the first input sound signal into frames having a given frame length (for example, several tens millisecond). Thereupon, the time frequency conversion unit 21 sets the frames such that, for example, two successive frames are offset by ½ the frame length from each other.

The time frequency conversion unit 21 executes window processing for each frame. For example, the time frequency conversion unit 21 multiplies each frame by a given window function. For example, the time frequency conversion unit 21 may use a hanning window as the window function.

The time frequency conversion unit 21 converts, every time it receives a frame for which window processing has been performed, the frame from that in the time domain to that in the frequency domain to calculate a frequency spectrum including an amplitude component and a phase component for each of a plurality of frequencies. The time frequency conversion unit 21 may calculate a frequency spectrum, for example, by executing time frequency conversion such as fast Fourier transform (FFT) for each frame. It is to be noted that, in the following description, a frequency spectrum obtained in regard to the first input sound signal is referred to as first frequency spectrum and a frequency spectrum obtained in regard to the second input sound signal is referred to as second frequency spectrum for the convenience of description.

The time frequency conversion unit 21 outputs the first frequency spectrum for each frame to the noise power calculation unit 22 and the sound source direction decision unit 24. Further, the time frequency conversion unit 21 outputs the second frequency spectrum for each frame to the sound source direction decision unit 24 and the correction unit 26.

The noise power calculation unit 22 is an example of a noise level evaluation unit and calculates power of noise for each frame based on the first frequency spectrum. It is supposed that the time variation of the power of noise components is comparatively small. Therefore, in the case where the difference between the power of noise in the immediately preceding frame and the power of the first sound signal in the current frame is included within a given range, the noise power calculation unit 22 updates the power of noise in the immediately preceding frame based on the power of the first sound signal in the current frame.

The noise power calculation unit 22 calculates the power P1(t) of the first sound signal in the current frame in accordance with the following expression:

$$P1(t)=\Sigma_f\{Re(I1(f))^2+Im(I1(f))^2\} \quad (1)$$

where I1(f) represents a frequency component of a frequency f included in the first frequency spectrum. Further, Re(I1(f)) represents a real component of I1(f) and Im(I1(f)) represents an imaginary component of I1(f).

Further, the noise power calculation unit 22 calculates the power of noise of the current frame in accordance with the following expression:

$$\mathrm{NP}(t)=\alpha\times\mathrm{NP}(t-1)+(1-\alpha)\times P1(t) \text{ if } 0.5\times P1(t-1)<P1(t)<2\times P1(t-1)$$

$$\mathrm{NP}(t)=\mathrm{NP}(t-1) \text{ else} \quad (2)$$

where NP(t−1) represents the power of noise in the immediately preceding frame, and NP(t) represents the power of noise in the current frame. Further, the coefficient α is a forgetting factor and is set, for example, to 0.9 to 0.99. Further, P1(t−1) represents the power of the first sound signal in the immediately preceding frame.

The noise power calculation unit 22 outputs the calculated power of noise for each frame to the bandwidth controlling unit 23.

The bandwidth controlling unit 23 decides, for each frame, the coming direction of sound in accordance with the power of noise and besides controls the width of a frequency band to be made a unit for setting a gain. In the present embodiment, the bandwidth controlling unit 23 increases the width of the frequency band as the power of noise increases.

Figure 4:
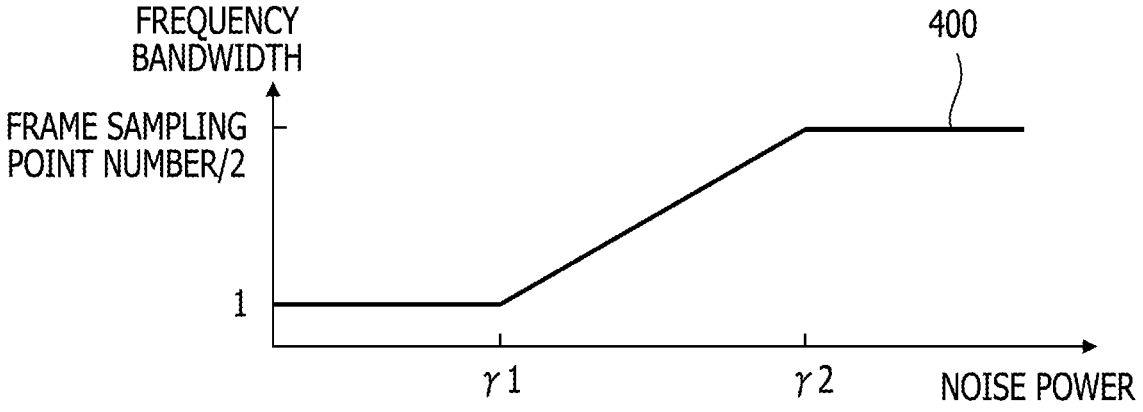
FIG. 4 depicts an example of a relationship between power of noise and a width of a frequency band.

FIG. 4 depicts an example of a relationship between power of noise and a width of a frequency band. Referring to FIG. 4, the axis of abscissa represents the power of noise and the axis of ordinate represents the width of a frequency band. Further, a graph 400 represents a relationship between the power of noise and the width FBW of the frequency band. It is to be noted that the width FBW of the frequency band is represented by a width of the frequency according to a sampling point number included in frames that become a unit for which time frequency conversion is to be performed (for example, a maximum value of the width FBW of the frequency band corresponds to the (sampling point number in a frame)/2, for example, one half the sampling point number in a frame). As indicated by the graph 400, in the case where the power of noise is equal to or lower than a lower limit threshold value γ1, the width FBW of the frequency band is set to a sampling point of one frequency. In the case where the power of noise is higher than the lower limit threshold value γ1 buts is lower than an upper limit threshold value γ2, the width FBW of the frequency band increases as the power of noise increases. If the power of noise is equal to or higher than the upper limit threshold value γ2, the width FBW of the frequency band is set so as to be equal to one half the sampling point number in a frame. It is to be noted that the lower limit threshold value γ1 and the upper limit threshold value γ2 are set, for example, to 60 dbA and 66 dbA, respectively.

A reference table representative of a relationship between the power of noise and the width of a frequency band is stored in advance, for example, in the memory the bandwidth controlling unit 23 includes, and the bandwidth controlling unit 23 refers to the reference table to set, for each frame, a width of a frequency band according to the power of noise in the frame. It is to be noted that the relationship between the power of noise and the width of a frequency band represented by the reference table may be, for example, the relationship indicated by the graph 400 of FIG. 4. Then, the bandwidth controlling unit 23 notifies the sound source direction decision unit 24 of the set width of the frequency band for each frame.

The sound source direction decision unit 24 divides, for each frame, the first frequency spectrum and the second frequency spectrum for each frequency band having the notified width. Then, the sound source direction decision unit 24 compares, for each frequency band, the power of sound coming from the first direction and the power of sound coming from the second direction with each other.

First, the sound source direction decision unit 24 determines, for example, for each frame, a phase spectrum difference representative of a phase difference for each frequency between the first frequency spectrum and the second frequency spectrum. Since this phase spectrum difference varies in response to the direction from which the sound comes in the frame, the phase spectrum difference may be utilized for specification of the direction from which the sound comes. For example, the sound source direction decision unit 24 determines the phase spectrum difference $\Delta\theta(f)$ in accordance with the following expression:

$$\Delta\theta(f) = \tan^{-1}\left(\frac{IN1(f)}{IN2(f)}\right) \quad 0 < f < Fs/2 \tag{3}$$

where IN1(f) represents a frequency component of the frequency f included in the first frequency spectrum, and IN2(f) represents a frequency component of the frequency f included in the second frequency spectrum. Further, Fs represents a sampling frequency in the analog/digital converters 12-1 and 12-2. It is to be noted that the distance between the microphones 11-1 and 11-2 depicted in FIG. 2 is smaller than the sound velocity/Fs.

Figure 5:
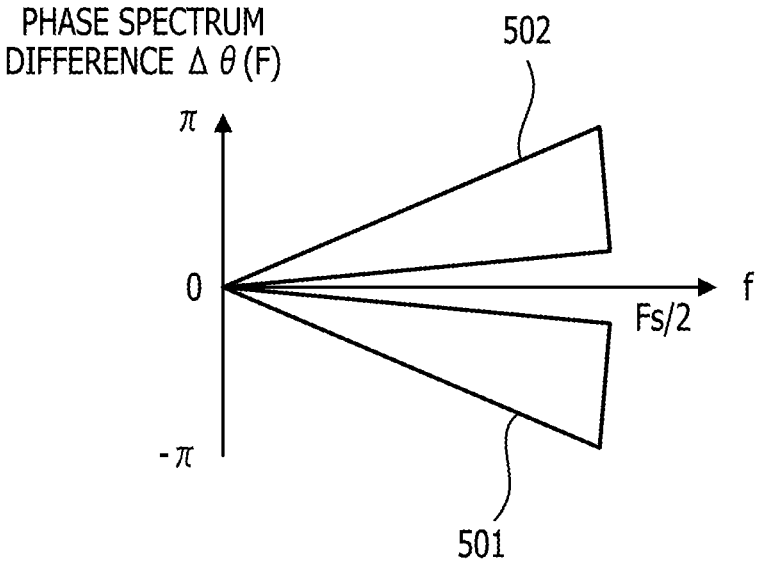
FIG. 5 depicts an example of a relationship between a coming direction of sound and a phase spectrum difference.

FIG. 5 depicts an example of a relationship between a coming direction of sound and a phase spectrum difference. Referring to FIG. 5, the axis of abscissa represents the frequency and the axis of ordinate represents the phase spectrum difference. A range 501 of the phase spectrum difference is a range within which the phase difference for each frequency may take in the case where sound coming from the first direction (in the present embodiment, from the direction in which the driver is positioned) is included in the first input sound signal and the second input sound signal. Meanwhile, another range 502 of the phase spectrum difference represents a range within which the phase difference for each frequency may take in the case where sound coming from the second direction (in the present embodiment, from the direction in which the passenger is positioned) is included in the first input sound signal and the second input sound signal.

To the driver, the microphone 11-2 is positioned nearer than the microphone 11-1. Therefore, the timing at which sound emitted from the driver arrives at the microphone 11-1 is later than the timing at which the sound arrives at the microphone 11-2. As a result, the phase of the sound emitted from the driver as represented by the first frequency spectrum lags behind the phase of the sound emitted from the driver as represented by the second frequency spectrum. Therefore, the range 501 of the phase spectrum difference is positioned on the negative side. Further, the range of the phase difference by the lag increases as the frequency increases. Conversely, to the passenger, the microphone 11-1 is positioned nearer than the microphone 11-2. Therefore, the timing at which sound emitted by the passenger arrives at the microphone 11-2 is later than the timing at which the sound arrives at the microphone 11-1. As a result, the phase of the sound emitted from the passenger as represented by the first frequency spectrum advances from the phase of the sound emitted from the passenger as represented by the second frequency spectrum. Therefore, the range 502 of the phase spectrum difference is positioned on the positive side. Further, the range of the phase difference increases as the frequency increases.

Therefore, the sound source direction decision unit 24 refers to the phase spectrum difference $\Delta\theta(f)$ to decide for each frequency whether the phase difference is included in the range 501 or in the range 502 of the phase spectrum difference. Then, the sound source direction decision unit 24 decides for each frequency that, in the first and second frequency spectra, a frequency component in regard to which the phase difference is included in the range 501 of the phase spectrum difference is a component that is included in the sound coming from the first direction. Then, the sound source direction decision unit 24 extracts, for each frequency band, a frequency component of the second frequency spectrum in regard to a frequency in which the phase difference is included in the range 501 of the phase spectrum difference from among the frequencies included in the frequency band to form a first directional sound spectrum. Further, the sound source direction decision unit 24 extracts, for each frequency band, a frequency component of the second frequency spectrum in regard to a frequency in regard to which the phase difference is included in the range 502 of the phase spectrum difference from among frequencies included in the frequency band to form a second directional sound spectrum. It is to be noted that the sound source direction decision unit 24 may otherwise extract a frequency component of the first frequency spectrum in regard to the frequencies in regard to which the phase difference is included in the range 502 of the phase spectrum difference to form a second directional sound spectrum. Furthermore, the sound source direction decision unit 24 may extract a frequency component of the first frequency spectrum also in regard to the frequencies in regard to which the phase difference is included in the range 501 of the phase spectrum difference to form a first directional sound spectrum. Moreover, the sound source direction decision unit 24 may extract, for each frequency band, a frequency component of the first or second frequency spectrum in regard to frequencies in regard to which the phase difference is out of the range 501 of the phase spectrum difference among the frequencies included in the frequency band to form a second directional sound spectrum. In this case, a direction other than the first direction is the second direction.

The sound source direction decision unit 24 calculates, for each frequency band, the sum of power of frequency components included in each of the first and second directional sound spectra as the power of the directional sound in the frequency band in regard to each of the first and second directional sound spectra. Further, the sound source direction decision unit 24 calculates, for each frequency band fb, the directional sound power ratio (D(fb)=PD1(fb)/PD2(fb)), which is the ratio of the power PD1(fb) of the first directional sound to the power PD2(fb) of the second directional sound. The directional sound power ratio D(fb) is an example of a comparison result between the power of the first directional sound and the power of the second directional sound. Further, the directional sound power ratio D(fb) is an index representative of a direction from which sound comes in regard to the corresponding frequency band and represents that, as the directional sound power ratio D(fb) increases, the power of the frequency component included in the sound coming from the first direction increases.

The sound source direction decision unit 24 notifies, for each frame, the gain setting unit 25 of the directional sound power ratio of each frequency band.

The gain setting unit 25 calculates the gain for each frequency band for each frame. In the present embodiment, as the directional sound power ratio decreases, for example, as the power of a frequency component of sound coming from other directions than the first direction increases, the gain is set lower. Consequently, in a frequency band in which the directional sound power ratio indicates a decreasing value, the frequency components of each frequency included in the frequency band are suppressed more.

Figure 6:
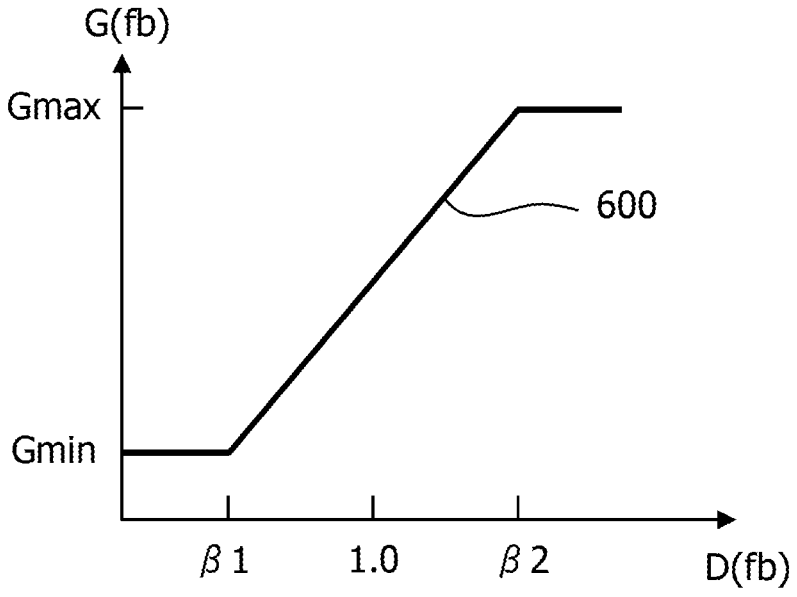
FIG. 6 depicts an example of a relationship between a directional sound power ratio and a gain.

FIG. 6 depicts an example of a relationship between a directional sound power ratio and a gain. In FIG. 6, the axis of abscissa represents the directional sound power ratio D(fb) and the axis of ordinate represents the gain G(fb). Further, a graph 600 represents a relationship between the directional sound power ratio D(fb) and the gain G(fb). As indicated by the graph 600, in the case where the directional sound power ratio D(fb) is equal to or lower than a lower limit threshold value β1, the gain G(fb) is set to a minimum value Gmin (for example, 0.1) of the gain. In the case where the directional sound power ratio D(fb) is higher than the lower limit threshold value β1 but is lower than an upper limit threshold value β2, the gain G(fb) increases as the directional sound power ratio D(fb) increases. Then, if the directional sound power ratio D(fb) is equal to or higher than the upper limit threshold value β2, the gain G(fb) is set so as to be equal to a maximum value Gmax (for example, 1.0 that represents no suppression). It is to be noted that the lower limit threshold value β1 and the upper limit threshold value β2 are set, for example, to 0.7 and 1.4, respectively.

The gain setting unit 25 refers, for each frame, to a reference table that represents a relationship between the directional sound power ratio and the gain and is stored in advance, for example, in the memory the gain setting unit 25 includes, to set, for each frequency band, a gain according to the directional sound power ratio of the frequency band. It is to be noted that the relationship between the directional sound power ratio and the gain represented by the reference table may be set, for example, to such a relationship as indicated by the graph 600 of FIG. 6. Then, the gain setting unit 25 notifies the correction unit 26 of the gain of each frequency band for each frame.

The correction unit 26 multiplies, for each frequency band for each frame, each frequency component of the second frequency spectrum included in the frequency band by the gain set for the frequency band to correct the second frequency spectrum.

Figure 7:
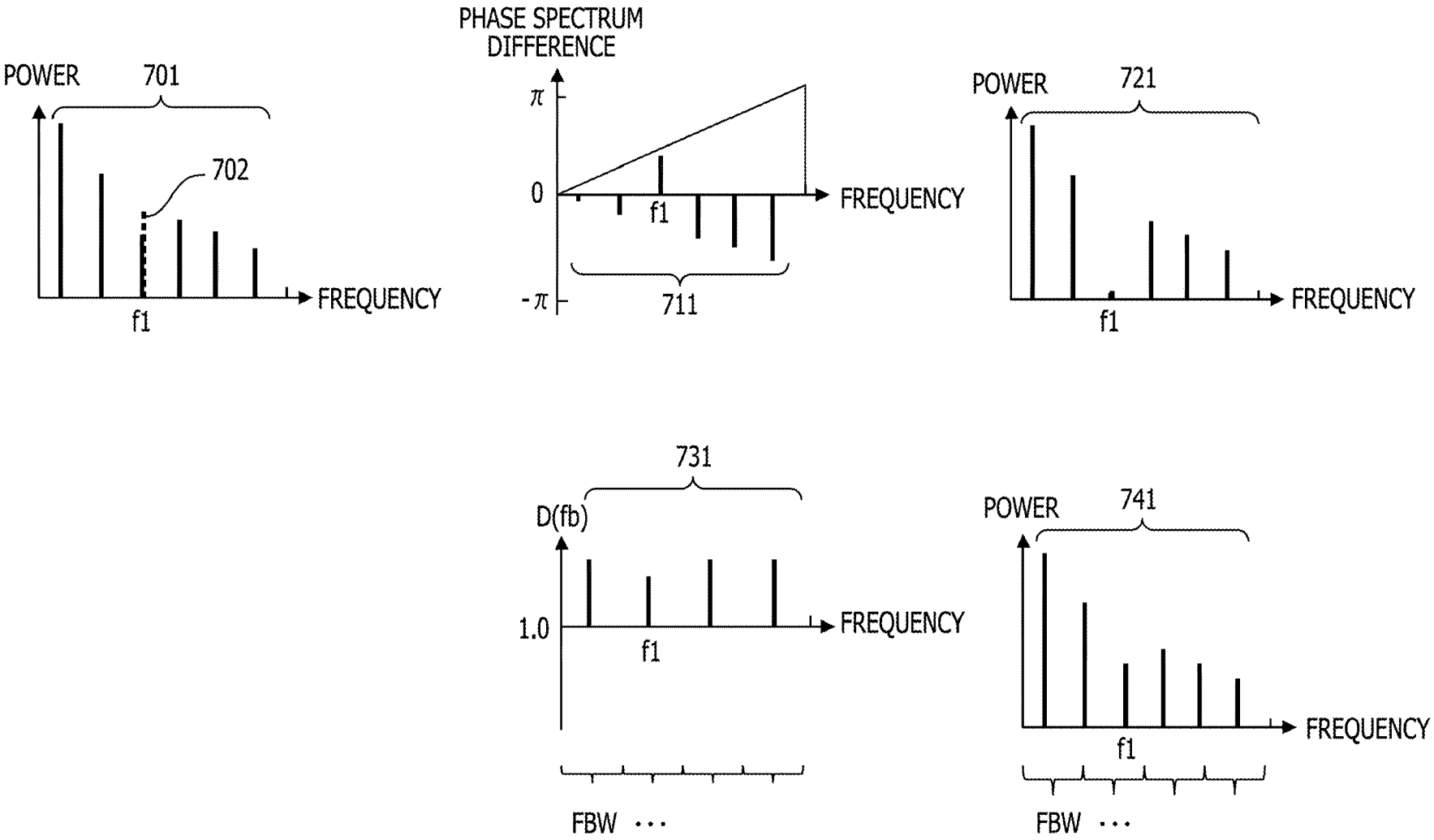
FIG. 7 illustrates an overview of sound processing by the embodiment.

FIG. 7 illustrates an overview of sound processing by the present embodiment. In a graph represented at the left side at an upper stage in FIG. 7, the axis of abscissa represents the frequency and the axis of ordinate represents the power of the frequency component. A profile 701 represented by a set of bar graphs represents an example of a frequency spectrum of sound from the driver included in the first frequency spectrum. Meanwhile, a bar graph 702 of a broken line represents a frequency spectrum of a noise component. In this example, at a frequency f1, the frequency component of noise is greater than the frequency component of the sound from the driver.

A central graph at the upper stage in FIG. 7 represents the phase difference between the first frequency spectrum and the second frequency spectrum for each frequency. In this graph, the axis of abscissa represents the frequency and the axis of ordinate represents the phase difference. Further, individual bar graphs 711 represent phase differences at the corresponding frequencies. In this example, at the frequency f1, the frequency component of noise is greater than the frequency component of the sound from the driver, and therefore, the phase difference at the frequency f1 is in the positive, and it may be decided that the coming direction of the sound regarding the frequency f1 is the second direction (for example, the passenger's seat side direction). On the other hand, at any frequency other than the frequency f1, the phase difference is in the negative, and it may be decided that the coming direction of the sound is the first direction (for example, the driver side direction).

A graph at the right side at the upper stage in FIG. 7 represents a second frequency spectrum corrected in the case where a gain is set based on a phase difference for each frequency according to the related art. In this graph, the axis of abscissa represents the frequency and the axis of ordinate represents the power of the frequency component. A profile 721 represented by a set of bar graphs indicates an example of a frequency spectrum of sound from the driver included in a corrected second frequency spectrum. In the case where the gain is controlled based on the phase difference for each frequency, the gain at the frequency f1 decided as a frequency component included in sound coming from other directions than the first direction indicates a low value. As a result, the frequency component at the frequency f1 is suppressed excessively as indicated by the profile 721.

A graph at the left side at the lower stage in FIG. 7 represents a directional sound power ratio for each frequency band. In this paragraph, the axis of abscissa represents the frequency and the axis of ordinate indicates the directional sound power ratio D(fb). Each bar graph 731 represents the directional sound power ratio D(fb) for the frequency band. In the present embodiment, the first and second directional sound powers are calculated for each frequency band having a width FBW set in response to the noise power, and the directional sound power ratio D(fb) is calculated for each frequency band based on the first and second directional sound powers. Therefore, as indicated by the bar graphs 731, also in regard to a frequency band that includes the frequency f1, the directional sound power ratio D(fb) has a value equal to or greater than 1.0 similarly as in the other frequency bands. Therefore, the influence of noise is suppressed.

A graph at the right side at the lower stage in FIG. 7 depicts an example of a second frequency spectrum corrected after gain multiplication. In this graph, the axis of abscissa represents the frequency and the axis of ordinate represents the power of the frequency component. A profile 741 represented by a set of bar graphs indicates an example of a frequency spectrum of sound from the driver included in the corrected second frequency spectrum.

In the present embodiment, since a gain is set based on the directional sound power ratio D(fb) for each frequency band, the difference between the gain in the frequency band that includes the frequency f1 and the gain in any other frequency band is small. Therefore, also at the frequency f1, the frequency component of sound from the driver is not suppressed very much. Therefore, it is recognized that the sound from the driver is suppressed from being suppressed excessively.

It is to be noted that, also in the present embodiment, in the case where sound comes from any other direction than the first direction as in the case where the driver does not emit sound and the passenger emits sound, in each frequency band, the directional sound power ratio D(fb) is lower than 1.0. As a result, the gain G(fb) in each frequency band has a relatively low value. Accordingly, sound coming from any other direction than the first direction is suppressed.

The correction unit 26 outputs the corrected second frequency spectra to the frequency time conversion unit 27 for each frame.

The frequency time conversion unit 27 frequency time converts, for each frame, the corrected second frequency spectrum outputted from the correction unit 26 into a signal in the time domain to obtain a directional sound signal for each frame. It is to be noted that the frequency time conversion is inverse conversion to the time frequency conversion performed by the time frequency conversion unit 21.

The frequency time conversion unit 27 adds directional sound signals for individual frames successively in a time order (for example, in a reproduction order) in a successively displaced relationship by ½ frame length to calculate a directional sound signal. Then, the frequency time conversion unit 27 outputs the directional sound signal to a different apparatus through the communication interface unit 14.

Figure 8:
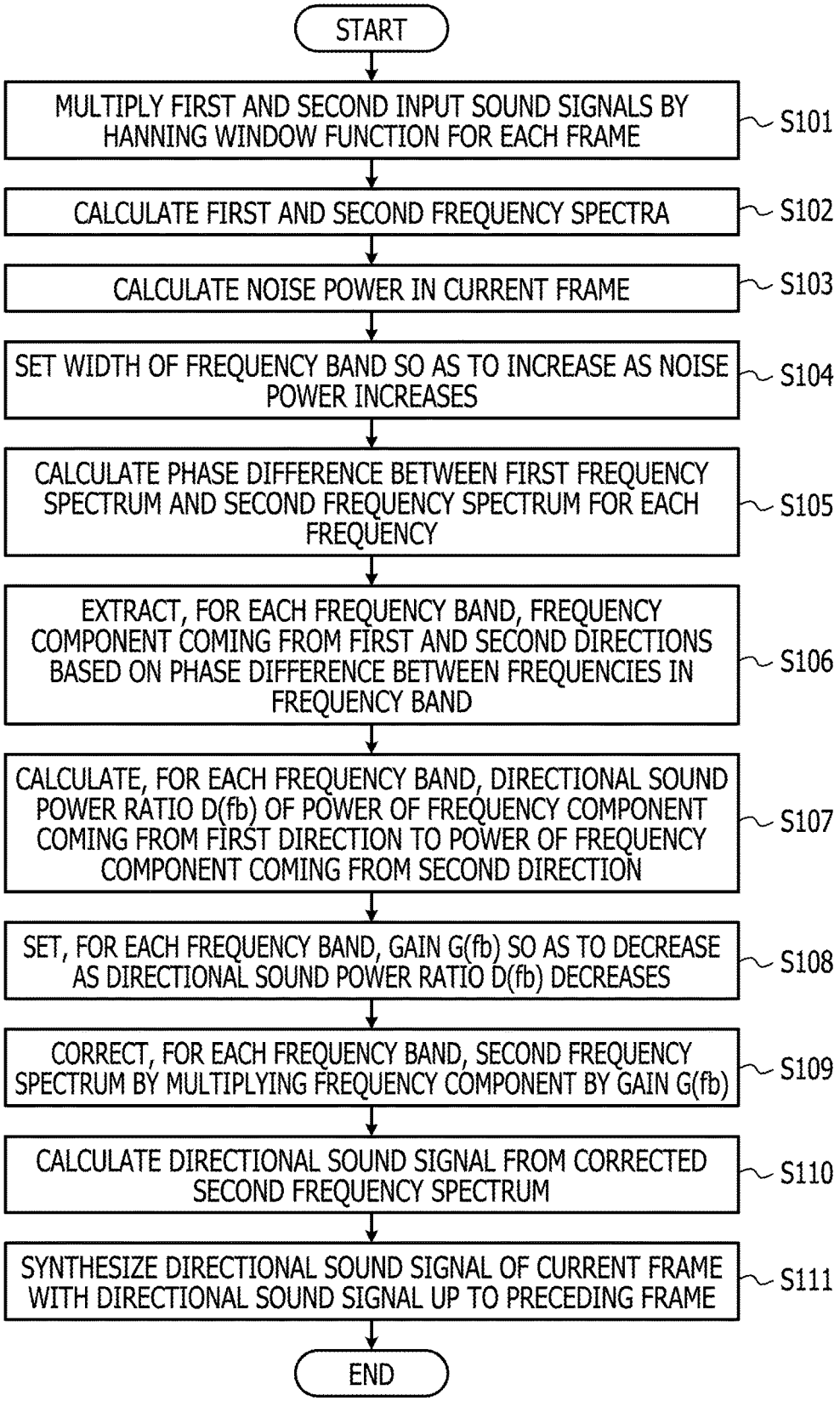
FIG. 8 depicts a flow chart of operation of the sound processing.

FIG. 8 depicts a flow chart of operation of the sound processing. The sound processing apparatus 13 executes the sound processing in accordance with the flow chart described below for each frame.

The time frequency conversion unit 21 multiplies a first input sound signal and a second input sound signal, which have been divided into frame units for which time frequency conversion is to be performed, by a hanning window function (step S101). Then, the time frequency conversion unit 21 time frequency converts the first input sound signal and the second input sound signal to calculate a first frequency spectrum and a second frequency spectrum (step S102).

The noise power calculation unit 22 calculates the power of noise in a current frame based on the power of the first frequency spectrum and the power of noise in an immediately preceding frame (step S103). Then, the bandwidth controlling unit 23 decides a coming direction of sound and sets a width for a frequency band, which is to become a unit for setting a gain, such that the width of the frequency band increases as the power of noise increases (step S104).

The sound source direction decision unit 24 determines a phase difference for each frequency between the first frequency spectrum and the second frequency spectrum (step S105). The sound source direction decision unit 24 extracts, based on the phase difference for each frequency, frequency components included in sound coming from the first direction and frequency components included in sound coming from the second direction (step S106). The sound source direction decision unit 24 calculates, for each frequency band having a set width, power of the first directional sound from frequency components included in the sound coming from the first direction and included in the frequency band. Similarly, the sound source direction decision unit 24 calculates power of the second directional sound from frequency components included in the sound coming from the second direction and included in the frequency band. Then, the sound source direction decision unit 24 calculates, for each frequency band having the set width, the directional sound power ratio D(fb) that is a ratio of the first directional sound power to the second directional sound power (step S107).

The gain setting unit 25 sets the gain G(fb) for each frequency band such that the gain G(fb) decreases as the directional sound power ratio D(fb) of the frequency band decreases (step S108). Then, the correction unit 26 multiplies, for each frequency band, the component of the frequency of the second frequency spectrum included in the frequency band by the gain set for the frequency band to correct the second frequency spectrum (step S109).

The frequency time conversion unit 27 frequency time converts the corrected second frequency spectrum to calculate a directional sound signal (step S110). Then, the frequency time conversion unit 27 synthesizes the directional sound signal of the current frame with the directional sound signal obtained up to the preceding frame in an offset relationship by one half frame length (step S111). Then, the sound processing apparatus 13 ends the sound processing.

As described above, the present sound processing apparatus compares, for each frequency band, the power of sound coming from a first direction and the power of noise coming from any other direction with each other and sets a gain in response to a result of the comparison. Therefore, the sound processing apparatus may suppress the gain from becoming excessively low even in regard to a frequency in regard to which a frequency component of noise is greater than a frequency component of the sound coming from the first direction. Further, the sound processing apparatus decides the coming direction of sound and increases, as the level of noise increases, the width of a frequency band to be made a unit for setting of a gain. Therefore, even if frequencies at which the frequency component of noise is higher than the frequency component of sound coming from the specific direction increase, the gain is suppressed from being excessively decreased. As a result, the sound processing apparatus may suppress excessive suppression of the sound coming from the first direction.

It is to be noted that, according to a modification, the sound processing apparatus may decide a coming direction of sound based on the signal to noise ratio in place of the level of noise and control the width of a frequency band that becomes a unit for setting a gain.

Figure 9:
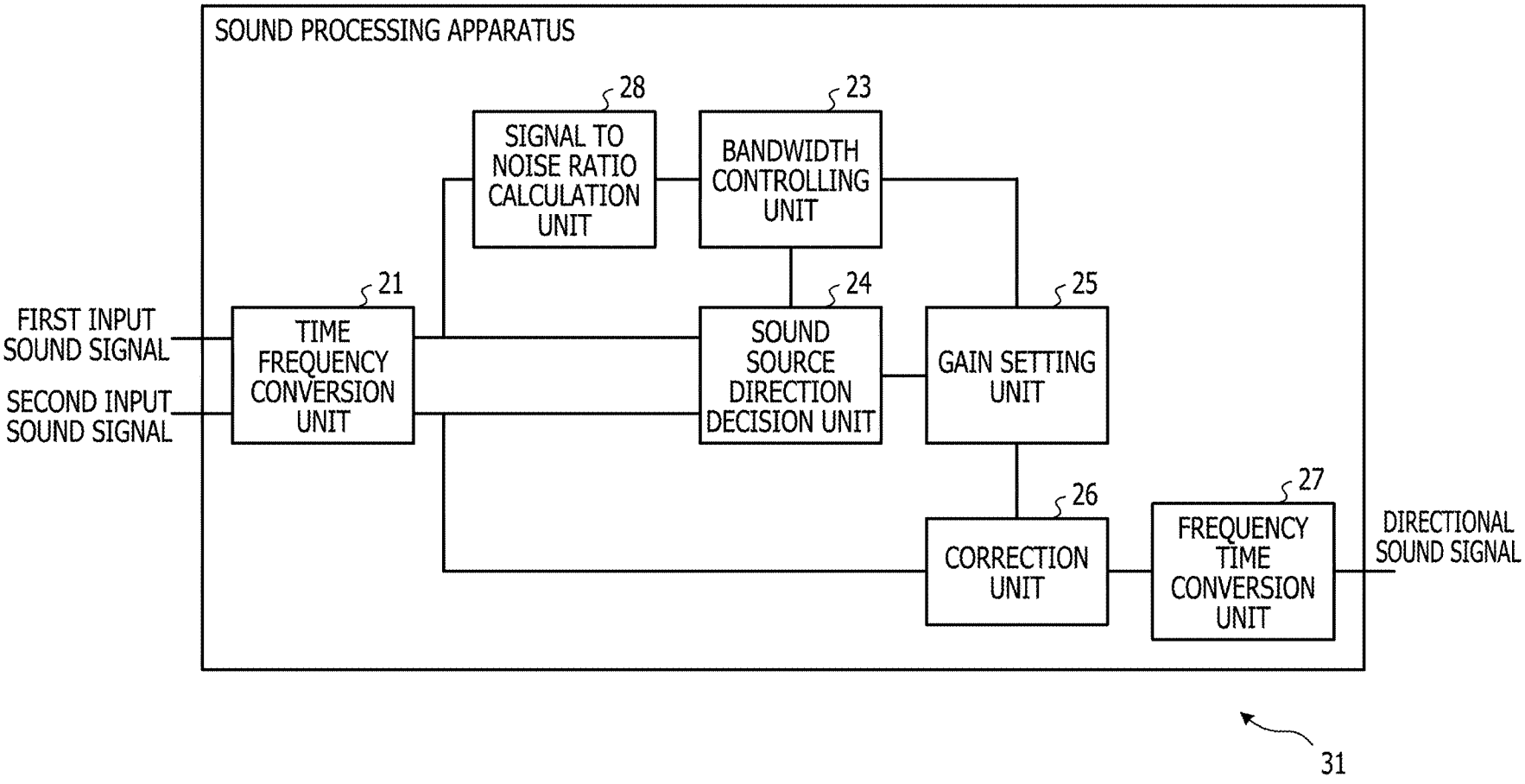
FIG. 9 depicts a schematic configuration of a sound processing apparatus according to a modification.

FIG. 9 depicts a schematic configuration of a sound processing apparatus according to the modification. The sound processing apparatus 31 includes a time frequency conversion unit 21, a signal to noise ratio calculation unit 28, a bandwidth controlling unit 23, a sound source direction decision unit 24, a gain setting unit 25, a correction unit 26 and a frequency time conversion unit 27. The sound processing apparatus 31 is different from the sound processing apparatus 13 depicted in FIG. 3 in that it includes the signal to noise ratio calculation unit 28 in place of the noise power calculation unit 22 and also in processing of the bandwidth controlling unit 23. Therefore, the signal to noise ratio calculation unit 28 and the bandwidth controlling unit 23 are described in the following. For the other components of the sound processing apparatus 31, refer to the description of the corresponding components of the sound processing apparatus 13.

The signal to noise ratio calculation unit 28 is a different example of the noise level evaluation unit and calculates the signal to noise ratio in a first frequency spectrum for each frame. The signal to noise ratio calculation unit 28 may calculate the power of the first sound signal in accordance with the expression (1) and calculate the power of noise in the current frame in accordance with the expression (2) similarly to the noise power calculation unit 22. Further, it is supposed that the time variation of the power of a signal component is comparatively great. Therefore, in the case where the difference between the power of a signal component in the immediately preceding frame and the power of the first sound signal in the current frame is outside a given range, the signal to noise ratio calculation unit 28 updates the signal component in the immediately preceding frame based on the power of the first sound signal in the current frame.

For example, the signal to noise ratio calculation unit 28 calculates the power of the signal component of the current frame in accordance with the following expression:

$$SP(t)=\alpha\times SP(t-1)+(1-\alpha)\times P1(t) \text{ if } P1(t)<0.5\times P1(t-1) \text{ or } 2\times P1(t-1)<P1(t)$$

$$SP(t)=SP(t-1) \text{ else} \quad (4)$$

where SP(t−1) represents the power of the signal component in the immediately preceding frame, and SP(t) represents the power of the signal component of the current frame. Further, the coefficient $\alpha$ is a forgetting factor and is set, for example, to 0.9 to 0.99.

The signal to noise ratio calculation unit 28 further calculates the signal to noise ratio SNR in the current frame in accordance with the following expression:

$$SNR=10\times\log_{10}(SP(t)/NP(t)) \quad (5)$$

The signal to noise ratio calculation unit 28 outputs the calculated signal to noise ratio to the bandwidth controlling unit 23 for each frame.

The bandwidth controlling unit 23 decides, for each frame, the coming direction of sound in accordance with the signal to noise ratio and controls the width of a frequency band that becomes a unit for setting of a gain. In the present embodiment, the bandwidth controlling unit 23 increases the width of the frequency band as the signal to noise ratio decreases.

Figure 10:
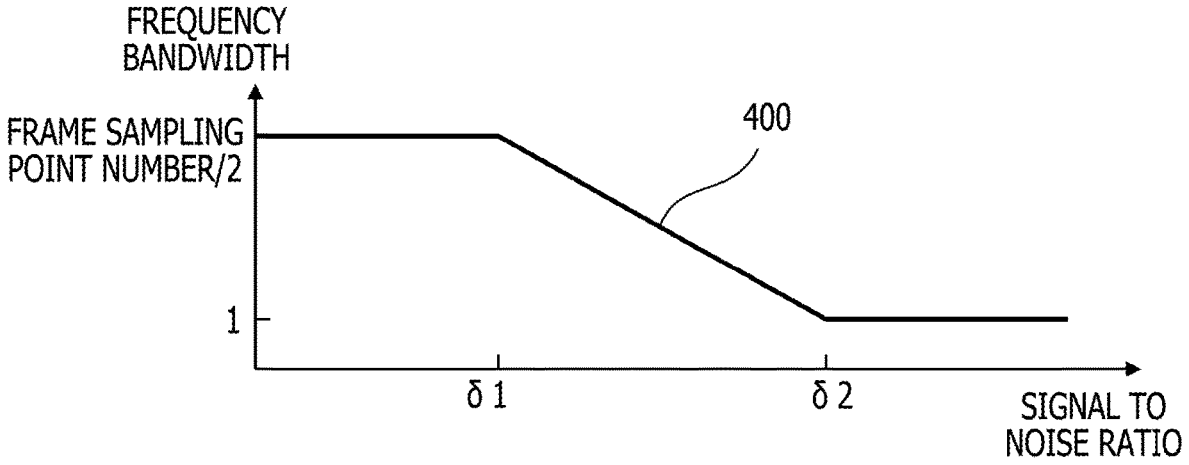
FIG. 10 depicts an example of a relationship between a signal to noise ratio and a width of a frequency band.

FIG. 10 depicts an example of a relationship between a signal to noise ratio and a width of a frequency band. Referring to FIG. 10, the axis of abscissa represents the signal to noise ratio and the axis of ordinate represents the width of the frequency band. A graph 1000 represents a relationship between the signal to noise ratio and the width FBW of the frequency band. It is to be noted that, in the present example, the width FBW of the frequency band is represented by the width of the frequencies according to the sampling point number included in the frame (for example, the maximum value of the width FBW of the frequency band corresponds to one half the sampling point number of the frame). As indicated by the graph 1000, in the case where the signal to noise ratio is equal to or lower than a lower limit threshold value δ1, the width FBW of the frequency band is set so as to be equal to one half the sampling point number of the frame. However, in the case where the signal to noise ratio is higher than the lower limit threshold value δ1 but is lower than an upper limit threshold value δ2, the width FBW of the frequency band decreases as the signal to noise ratio increases. If the signal to noise ratio is equal to or higher than the upper limit threshold value δ2, the width FBW of the frequency band is set to one sampling point of the frequency. It is to be noted that lower limit threshold value δ1 and the upper limit threshold value δ2 are set, for example, to 10 db and 13 db, respectively.

The bandwidth controlling unit 23 refers to a reference table, which is stored, for example, in advance in the memory the bandwidth controlling unit 23 includes and represents a relationship between the signal to noise ratio and the width of the frequency band, to set, for each frame, a width of the frequency band according to the signal to noise ratio of the frame. It is to be noted that the relationship between the power of noise and the width of the frequency band represented by the reference table may be, for example, a relationship indicated by the graph 1000 of FIG. 10. The bandwidth controlling unit 23 notifies the sound source direction decision unit 24 of the set width of the frequency band for each frame.

Also the sound processing apparatus according to the present modification compares, for each frequency band, the power of sound coming from a first direction and the power of sound coming from any other direction and sets a gain in response to a result of the comparison similarly as in the embodiment described hereinabove. Therefore, the present sound processing apparatus may suppress the gain from becoming excessively low even in regard to a frequency in regard to which a frequency component of noise is greater than a frequency component of the sound coming from the first direction. Further, the sound processing apparatus according to the present modification decides the coming direction of sound and increases, as the signal to noise ratio decreases, the width of a frequency band to be made a unit for setting of a gain. Therefore, even if frequencies at which the frequency component of noise is higher than the frequency component of sound coming from the specific direction increase, the gain is suppressed from being excessively decreased. As a result, the sound processing apparatus according to the present modification may suppress excessive suppression of the sound coming from the first direction.

On the other hand, according to a different modification, the sound processing apparatus may calculate the level of noise in regard to each of a plurality of fixed frequency bands having a fixed width set in advance. Then, the sound processing apparatus may determine a coming direction of sound in response to the noise level for each fixed frequency band and control the width of a frequency band to be made a unit for setting of a gain (in the present modification, the frequency band is called partial frequency band in order to facilitate distinction from the fixed frequency band).

Figure 11:
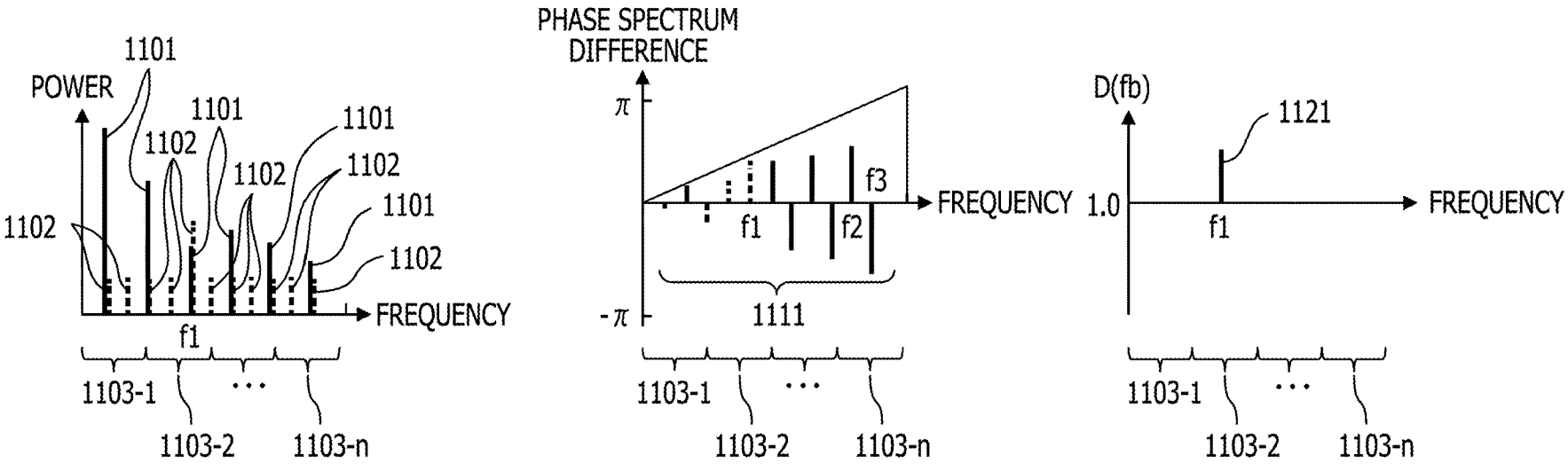
FIG. 11 illustrates an overview of frequency bandwidth control according to another modification.

FIG. 11 illustrates an overview of frequency bandwidth control according to the present modification. In a graph depicted at the left side in FIG. 11, the axis of abscissa represents the frequency and the axis of ordinate represents the power of the frequency component. A profile 1101 represented by a set of bar graphs indicates an example of a frequency spectrum of sound from the driver included in the first frequency spectrum. Meanwhile, a profile 1102 represented by a set of broken line bar graphs represents a frequency spectrum of noise components included in the first frequency spectrum. In the present example, for each of fixed frequency bands 1103-1, 1103-2, . . . , **1103-*n* (n is an integer equal to or greater than 2) having a fixed width WIDE, the power of noise is calculated. Further, in the present example, at the frequency f1, the power of noise is higher than the power of the frequency component of sound from the driver. Therefore, in the fixed frequency band 1103-2 that includes the frequency f1, the width of the partial frequency band is set greater. On the other hand, in the fixed frequency bands other than the fixed frequency band 1103-2 from among the fixed frequency bands 1103-1, 1103-2, . . . , 1103-*n***, since the power of noise is low, the width of the partial frequency band is set narrower. For example, the coming direction of sound is decided for each frequency.

A central graph in FIG. 11 represents the phase difference for each frequency between the first frequency spectrum and the second frequency spectrum. In this graph, the axis of abscissa represents the frequency and the axis of ordinate represents the phase difference. Further, each individual bar graph 1111 represents the phase difference in the corresponding frequency. In this example, in each of the fixed frequency bands other than the fixed frequency band 1103-2 including the frequency f1 from among the fixed frequency bands 1103-1, 1103-2, . . . , 1103-*n*, for each frequency, the coming direction of sound is decided based on the phase difference at the frequency. Accordingly, for example, at a frequency f2 at which the phase difference is in the positive, it is decided that the sound comes from the second direction (for example, from the passenger's seat side direction) while, at a frequency f3 at which the phase difference is in the negative, it is decided that the sound comes from the first direction (for example, from the driver direction). Then, for each frequency at which the phase difference is in the positive, the gain is set to a comparatively low value. In contrast, for each frequency at which the phase difference is in the negative, the gain is set to a comparatively high value. In this manner, in the fixed frequency bands other than the fixed frequency band 1103-2, the gain is controlled for each frequency.

A graph at the right side in FIG. 11 represents the directional sound power ratio in the fixed frequency band 1103-2 including the frequency f1. In this graph, the axis of abscissa represents the frequency and the axis of ordinate represents the directional sound power ratio D(fb). A bar graph 1121 represents the directional sound power ratio D(fb) of the fixed frequency band 1103-2. In this example, in regard to the fixed frequency band 1103-2, the entire fixed frequency band is set to one partial frequency band. Therefore, one directional sound power ratio D(fb) is calculated based on the components of the frequencies of the fixed frequency band 1103-2. Therefore, as indicated by the bar graph 1121, the directional sound power ratio D(fb) becomes equal to or higher than 1.0 also in regard to the fixed frequency band 1103-2, and therefore, the gain in the fixed frequency band 1103-2 has a somewhat high value. Therefore, also at the frequency f1, the frequency component of sound of the driver is suppressed from being suppressed excessively.

In this modification, the processes of the noise power calculation unit 22 and the bandwidth controlling unit 23 are different in comparison with the sound processing apparatus 13 depicted in FIG. 3. Therefore, in the following, the noise power calculation unit 22 and the bandwidth controlling unit 23 are described.

The noise power calculation unit 22 calculates, for each frame, the power of noise in each of a plurality of fixed frequency bands set in advance. Therefore, for example, the noise power calculation unit 22 calculates the power of noise of each frequency in accordance with the following expression:

$$NP(f,t)=\alpha\times NP(f,t-1)+(1-\alpha)\times I1P(f,t) \text{ if } 0.5\times P1(t-1)<P1(t)<2\times P1(t-1)$$

$$NP(f,t)=NP(f,t-1) \text{ else}$$

$$I1P(f,t)=Re(I1(f))^2+Im(I1(f))^2 \quad (6)$$

where NP(f,t) represents the power of noise in regard to the frequency fin the current frame. Meanwhile, NP(f,t−1) represents the power of noise in regard to the frequency fin the immediately preceding frame. Further, I1P(f,t−1) represents the power of the frequency component in regard to the frequency f of the first frequency spectrum in the current frame. Further, a is a forgetting coefficient.

Thus, the noise power calculation unit 22 may calculate, for each individual fixed frequency band, the sum of noise in the frequencies included in the fixed frequency band as power of noise in the fixed frequency band.

The noise power calculation unit 22 outputs the power of noise in each fixed frequency band to the bandwidth controlling unit 23 for each frame.

The bandwidth controlling unit 23 decides, for each frame, the coming direction of sound in accordance with the power of noise for each fixed frequency band and besides controls the width of a partial frequency band to be made a unit for setting of a gain. Also in this modification, the bandwidth controlling unit 23 increases the width of the partial frequency band as the power of the noise of the individual fixed frequency bands increases similarly as in the embodiment described hereinabove. However, in this example, the maximum value of the value of a partial frequency band is a width of the fixed frequency band to which the partial frequency band belongs.

The bandwidth controlling unit 23 notifies, for each fixed frequency band in each frame, the sound source direction decision unit 24 of the width of the partial frequency band set for the fixed frequency band. The sound source direction decision unit 24 may calculate, for each fixed frequency band in each frame, the directional sound power ratio for each partial frequency band having a width set in regard to the fixed frequency band similarly as in the embodiment described hereinabove. Then, the gain setting unit 25 may set, for each partial frequency band in each individual frequency band in each frame, a gain based on the directional sound power ratio in the partial frequency band similarly as in the embodiment described hereinabove.

Also the sound processing apparatus according to this modification sets, in regard to a fixed frequency band in which the level of noise is high, a gain in a unit of a partial frequency band having a somewhat great width similarly as in the embodiment described hereinabove. Therefore, also this sound processing apparatus may suppress the gain from becoming excessively low even in the case where, in some frequency, a frequency component of noise is greater than a frequency component of the sound coming from a noticed direction. On the other hand, in regard to a fixed frequency band in which the level of noise is low, the sound processing apparatus may set a gain for each frequency. In this manner, the sound processing apparatus may control, in regard to a fixed frequency band in which the level of noise is low, the gain for each individual frequency but may control, in regard to a fixed frequency band in which the level of noise is high, the gain for each partial frequency band having a certain width. Therefore, the present sound processing apparatus may improve the sound quality of the directional sound signal further while suppressing excessive suppression of sound coming from a specific direction.

It is to be noted that, in this modification, the sound processing apparatus may compare, for each fixed frequency band, the power of noise with a given noise level threshold value and determine, in regard to a fixed frequency band in which the power of noise is equal to or higher than a noise level threshold value, the entire fixed frequency band as one partial frequency band. Meanwhile, the sound processing apparatus may control, in regard to a fixed frequency band in which the power of noise is lower than the noise level threshold value, the individual frequencies as one partial frequency band. Alternatively, the sound processing apparatus may calculate the signal to noise ratio in place of the power of noise for each fixed frequency band and increase the width of the partial frequency band as the signal to noise ratio decreases.

Furthermore, in any of the embodiment and the modifications described above, the bandwidth controlling unit 23 sometimes decides a coming direction of sound and sets the width of a frequency band or a partial frequency band to be made a unit for setting a gain to a width corresponding to one frequency sampling point. In this case, the sound source direction decision unit 24 may not calculate the directional sound power ratio in the frequency band or the partial frequency band and calculate the phase difference at each frequency between the first frequency spectrum and the second frequency spectrum as depicted in FIG. 5. Further, in this case, the gain setting unit 25 may determine the gain of the frequency band or the partial frequency band based on the phase difference at each frequency between the first frequency spectrum and the second frequency spectrum. For example, the gain setting unit 25 may set the value to a value that decreases as the phase difference between the first frequency spectrum and the second frequency spectrum is displaced by an increasing amount away from the range 501 depicted in FIG. 5.

According to a further modification, the sound processing apparatus may control the lower limit threshold value $\gamma 1$ and the upper limit threshold value $\gamma 2$, which are to be used for determination of the width of the frequency band in which the coming direction of sound is to be decided, in response to an average value of the power of noise. As surrounding noise increases, a person utters with increasing sound. Therefore, if the level of noise decreases suddenly while a situation in which surrounding noise is averagely great continues, the sound of the driver becomes great relative to the noise. As a result, such a situation that noise components become greater than the signal component in the first frequency spectrum decreases. Therefore, the bandwidth controlling unit 23 may set the lower limit threshold value $\gamma 1$ and the upper limit threshold value $\gamma 2$ for the power of noise, which are utilized for determination of the width of the frequency band for determination of a coming direction of sound, to higher values as the average value of the power of noise become higher. For example, the bandwidth controlling unit 23 sets the width of the frequency band narrower with respect to the same power of noise as the average value of the power of noise increases. Consequently, when the power of noise decreases suddenly, the width of the frequency band for decision of the coming direction of sound is likely to become narrower. As a result, since, in such a case as just described, the sound processing apparatus may set the gain with a higher degree of preciseness, the quality of the directional sound signal may be improved further.

In this case, the noise power calculation unit 22 may calculate the average value of noise power, for example, in accordance with the following expression for each frame:

$$NPAVG(t)=\alpha\times NPAVG(t-1)+(1-\alpha)\times NP(t) \quad (7)$$

where NPAVG(t−1) represents the average value of power of noise in the immediately preceding frame, and NPAVG(t) represents the average value of the power of noise in the current frame. Further, the coefficient $\alpha$ is a forgetting coefficient and is set, for example, to 0.9 to 0.99.

The noise power calculation unit 22 may notify the bandwidth controlling unit 23 of the average value of the power of noise together with the power of noise for each frame.

Figure 12:
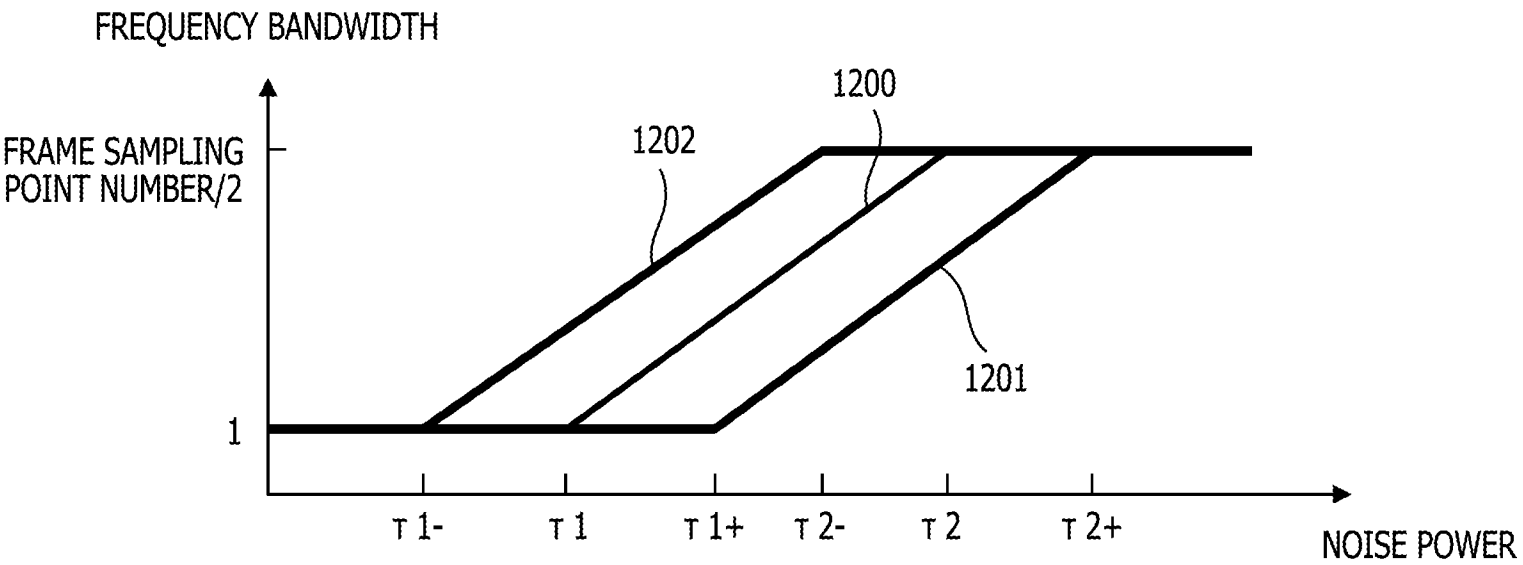
FIG. 12 depicts an example of a relationship among an average value of noise power, power of noise and a width of a frequency band.

FIG. 12 depicts an example of a relationship among an average value of noise power, power of noise and a width of a frequency band. Referring to FIG. 12, the axis of abscissa represents the power of noise and the axis of ordinate represents the width of the frequency band. Also in this example, the width FBW of the frequency band is represented by a width of the frequency according to the sampling point number included in a frame (for example, the maximum value of the width FBW of the frequency band corresponds to one half the sampling point number of the frame) similarly as in the embodiment described hereinabove. A graph 1200 represents a relationship between the power of noise and the width FBW of the frequency band in the case where the average value of the noise power is included within a given range (for example, within ±5 dbA) centered at a reference value (for example, 70 dbA). As indicated by the graph 1200, in the case where the power of noise is equal to or lower than the lower limit threshold value $\tau 1$, the width FBW of the frequency band is set to one frequency sampling point. Meanwhile, in the case where the power of noise is higher than the lower limit threshold value $\tau 1$ but is lower than the upper limit threshold value $\tau 2$, the width FBW of the frequency band increases as the power of noise increases. Further, if the power of noise is equal to or higher than the upper limit threshold value $\tau 2$, the width FBW of the frequency band is set so as to be equal to one half the sampling point number of the frame. It is to be noted that the lower limit threshold value $\tau 1$ and the upper limit threshold value $\tau 2$ are set, for example, 60 dbA and 66 dbA, respectively.

Another graph 1201 represents a relationship between the power of noise and the width FBW of the frequency band in the case where the average value of the noise power is higher than the given range centered at the reference value. As indicated by the graph 1201, in comparison with the case in which the average value of the noise power is included in the given range, the lower limit threshold value is changed from $\tau 1$ to $\tau 1+$ (for example, 65 dbA). Similarly, the upper limit threshold value is changed from $\tau 2$ to $\tau 2+$ (for example, 71 dbA). Accordingly, as the average value of the noise power becomes higher, the width FBW of the frequency band becomes likely to be set narrower.

A further graph 1202 represents a relationship between the power of noise and the width FBW of the frequency band in the case where the average value of the noise power is lower than the given range centered at the reference value. As indicated by the graph 1202, in comparison with the case in which the average value of the noise power is included in the given range, the lower limit threshold value is changed from $\tau 1$ to $\tau 1-$ (for example, 55 dbA). Similarly, the upper limit threshold value is changed from $\tau 2$ to $\tau 2-$ (for example, 61 dbA). Accordingly, as the average value of the noise power becomes lower, the width FBW of the frequency band becomes likely to be set wider.

According the present modification, the sound processing apparatus may set the width of the frequency band more appropriately in response the situation of noise around each microphone.

It is to be noted that, in any of the embodiment and the modifications described above, the noise power calculation unit 22 may calculate the power of noise based on the second frequency spectrum. Similarly, the signal to noise ratio calculation unit 28 may calculate a signal to noise ratio based on the second frequency spectrum. Further, the correction unit 26 may correct the first frequency spectrum in place of the second frequency spectrum. In this case, the frequency time conversion unit 27 may generate a directional sound signal by performing similar processes to those in the embodiment for the corrected first frequency spectrum.

Further, in any of the embodiment and the modifications described above, the sound source direction decision unit 24 may calculate the difference of the power of the secondary directional sound spectrum from the power of the first directional sound spectrum in place of calculating the directional sound power ratio for each frequency band. Alternatively, the sound source direction decision unit 24 may calculate, for each frequency band, a value by normalizing the difference with the power of the first or second directional sound spectrum. In this case, the gain setting unit 25 may set the gain to a value lower than 1 when the calculated value or the normalized value of the difference assumes a negative value but set the gain to 1 when the calculated difference or the normalized value of the difference is a value equal to or higher than 0.

The sound processing apparatus according to any of the embodiment and the modifications may be incorporated in an apparatus other than such a sound inputting apparatus as described above, for example, in a teleconference system.

A computer program that causes a computer to implement the functions the sound processing apparatus according to any of the embodiment and modifications includes may be provided in such a form that it is recorded in a computer-readable form such as a magnetic recording medium or an optical recording medium.

Figure 13:
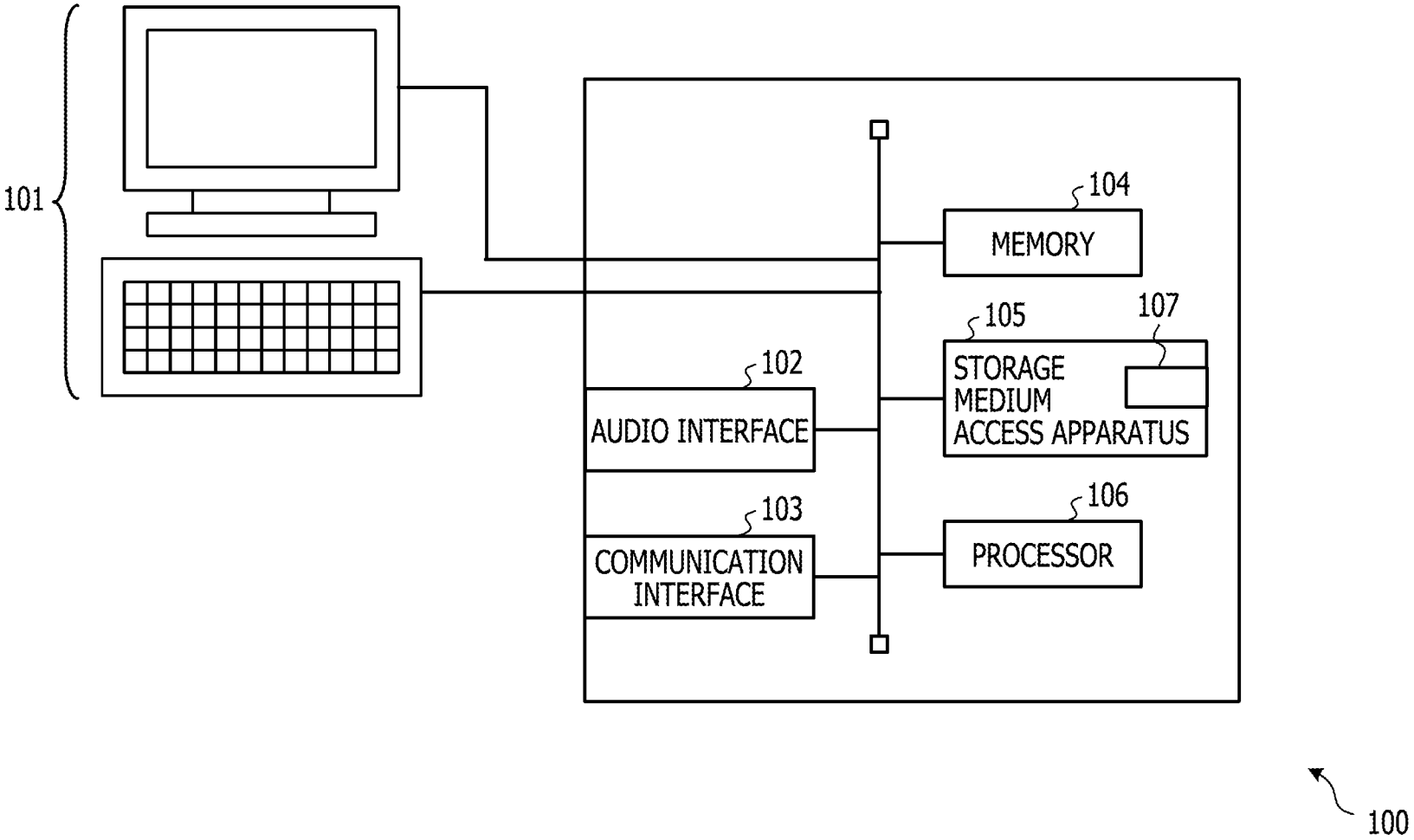
FIG. 13 depicts a configuration of a computer that operates as a sound processing apparatus when a computer program for implementing functions of components of the sound processing apparatus according to any of the embodiment and the modifications operates.

FIG. 13 depicts a configuration of a computer that operates as a sound processing apparatus when a computer program for implementing functions of the components of the sound processing apparatus according to any of the embodiment and the modifications described above operates.

The computer 100 includes a user interface 110, an audio interface 120, a communication interface 103, a memory 104, a storage medium access apparatus 105 and a processor 106. The processor 106 is coupled to the user interface 110, audio interface 120, communication interface 103, memory 104 and storage medium access apparatus 105, for example, through a bus.

The user interface 110 includes an inputting apparatus such as a keyboard and a mouse, and a display apparatus such as a liquid crystal display. Alternatively, the user interface 110 may include an apparatus that includes an inputting apparatus and a display apparatus integrated with each other such as a touch panel display. The user interface 110 outputs an operation signal for starting sound processing to the processor 106, for example, in response to an operation by the user.

The audio interface 120 includes an interface circuit for coupling the computer 100 to a microphone not depicted. Then, the audio interface 120 passes an input sound signal received from each of two or more microphones to the processor 106.

The communication interface 103 includes a communication interface for coupling to a communication network that complies with a communication standard such as Ethernet (registered trademark) and a control circuit for the communication interface. The communication interface 103 outputs a directional sound signal received, for example, from the processor 106 to a different apparatus through a communication network. As an alternative, the communication interface 103 may output a speech recognition result obtained by applying a speech recognition process to the directional sound signal to the different apparatus through the communication network. As another alternative, the communication interface 103 may output a signal generated by an application executed in response to the speech recognition result to the different apparatus through the communication network.

The memory 104 includes, for example, a readable and writable semiconductor memory and a read only semiconductor memory. The memory 104 stores a computer program for executing sound processing that is to be executed by the processor 106 and various data utilized in the sound processing or various signals and so forth generated during the sound processing.

The storage medium access apparatus 105 is an apparatus that accesses a storage medium 107 such as, for example, a magnetic disk, a semiconductor memory and an optical recording medium. The storage medium access apparatus 105 reads in a computer program for sound processing stored, for example, in the storage medium 107 so as to be executed by the processor 106 and passes the computer program to the processor 106.

The processor 106 includes, for example, a central processing unit (CPU) and peripheral circuits. Further, the processor 106 may include a processor for numerical value arithmetic operation. The processor 106 generates a directional sound signal from input sound signals by executing the sound processing computer program according to any of the embodiment and the modifications described above. Then, the processor 106 outputs the directional sound signal to the communication interface 103.

Further, the processor 106 may recognize sound emitted from a speaker positioned in the first direction by executing the speech recognition process for the directional sound signal. Then, the processor 106 may execute a given application in response to a result of the speech recognition. In this case, since, in the directional sound signal generated by the sound processing by any of the embodiment and the modifications, distortion of sound emitted from a speaker positioned in the first direction is suppressed, the processor 106 may improve the accuracy of the speech recognition.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A sound processing method performed by a computer, the method comprising:

executing a time frequency conversion process that includes converting a first sound signal acquired from a first sound inputting apparatus and a second sound signal acquired from a second sound inputting apparatus disposed at a position different from that of the first sound inputting apparatus into a first frequency spectrum and a second frequency spectrum in a frequency domain for each of frames having a given time length, respectively;

executing a noise level evaluation process that includes calculating, for each of the frames, one of power of noise and a signal to noise ratio based on one of the first frequency spectrum and the second frequency spectrum;

executing a bandwidth controlling process that includes setting, for each of the frames, a width of a frequency band in response to the one of the power of noise and the signal to noise ratio;

executing a sound source direction decision process that includes comparing, for each of the frames and for each of frequency bands having the width, first power of a frequency component, which is included in the frequency band of one of the first frequency spectrum and the second frequency spectrum, of sound coming from a first direction and second power of a frequency component, which is included in the frequency band of one of the first frequency spectrum and the second frequency spectrum, of sound coming from a second direction different from the first direction with each other;

executing a gain setting process that includes setting a gain according to a result of the comparison for each of the frames and for each of the frequency bands;

executing a correction process that includes calculating, for each of the frames and for each of the frequency bands, a frequency spectrum corrected by multiplying a frequency component included in the frequency band of one of the first frequency spectrum and the second frequency spectrum by the gain set for the frequency band; and executing a frequency time conversion process that includes generating a directional sound signal by frequency time converting the corrected frequency spectrum for each of the frames.

2. The sound processing method according to claim 1, wherein the bandwidth controlling process is configured to increase the width of the frequency band as the power of noise increases.

3. The sound processing method according to claim 1, wherein the bandwidth controlling process is configured to increase the width of the frequency band as the signal to noise ratio decreases.

4. The sound processing method according to claim 1, wherein the noise level evaluation process is configured to calculate, for each of the frames, the one of the power of noise and the signal to noise ratio in regard to each of a plurality of fixed frequency bands having a fixed width set in advance; and the bandwidth controlling process is configured to set the width in regard to each of the fixed frequency bands such that the width is equal to or smaller than the fixed width in response to the one of the power of noise and the signal to noise ratio.

5. The sound processing method according to claim 1, wherein the noise level evaluation process is configured to calculate the power of noise as the one and calculate an average value of the power of noise over the plurality of frames; and the bandwidth controlling process is configured to set, to the same power of noise, the width so as to decrease as the average value of the power of noise increases.

6. An apparatus for sound processing, the apparatus comprising:

a memory; and processor circuitry coupled to the memory, the processor circuitry being configured to execute a time frequency conversion process that includes converting a first sound signal acquired from a first sound inputting apparatus and a second sound signal acquired from a second sound inputting apparatus disposed at a position different from that of the first sound inputting apparatus into a first frequency spectrum and a second frequency spectrum in a frequency domain for each of frames having a given time length, respectively;

execute a noise level evaluation process that includes calculating, for each of the frames, one of power of noise and a signal to noise ratio based on one of the first frequency spectrum and the second frequency spectrum;

execute a bandwidth controlling process that includes setting, for each of the frames, a width of a frequency band in response to the one of the power of noise and the signal to noise ratio;

execute a sound source direction decision process that includes comparing, for each of the frames and for each of frequency bands having the width, first power of a frequency component, which is included in the frequency band of one of the first frequency spectrum and the second frequency spectrum, of sound coming from a first direction and second power of a frequency component, which is included in the frequency band of one of the first frequency spectrum and the second frequency spectrum, of sound coming from a second direction different from the first direction with each other;

execute a gain setting process that includes setting a gain according to a result of the comparison for each of the frames and for each of the frequency bands;

execute a correction process that includes calculating, for each of the frames and for each of the frequency bands, a frequency spectrum corrected by multiplying a frequency component included in the frequency band of one of the first frequency spectrum and the second frequency spectrum by the gain set for the frequency band; and execute a frequency time conversion process that includes generating a directional sound signal by frequency time converting the corrected frequency spectrum for each of the frames.

7. The apparatus according to claim 6, wherein the bandwidth controlling process is configured to increase the width of the frequency band as the power of noise increases.

8. The apparatus according to claim 6, wherein the bandwidth controlling process is configured to increase the width of the frequency band as the signal to noise ratio decreases.

9. The apparatus according to claim 6, wherein the noise level evaluation process is configured to calculate, for each of the frames, the one of the power of noise and the signal to noise ratio in regard to each of a plurality of fixed frequency bands having a fixed width set in advance; and the bandwidth controlling process is configured to set the width in regard to each of the fixed frequency bands such that the width is equal to or smaller than the fixed width in response to the one of the power of noise and the signal to noise ratio.

10. The apparatus according to claim 6, wherein the noise level evaluation process is configured to calculate the power of noise as the one and calculate an average value of the power of noise over the plurality of frames; and the bandwidth controlling process is configured to set, to the same power of noise, the width so as to decrease as the average value of the power of noise increases.

11. A non-transitory computer-readable storage medium for storing a sound processing program that causes a processor to execute a process, the process comprising:

executing a time frequency conversion process that includes converting a first sound signal acquired from a first sound inputting apparatus and a second sound signal acquired from a second sound inputting apparatus disposed at a position different from that of the first sound inputting apparatus into a first frequency spectrum and a second frequency spectrum in a frequency domain for each of frames having a given time length, respectively;

executing a noise level evaluation process that includes calculating, for each of the frames, one of power of noise and a signal to noise ratio based on one of the first frequency spectrum and the second frequency spectrum;

executing a bandwidth controlling process that includes setting, for each of the frames, a width of a frequency band in response to the one of the power of noise and the signal to noise ratio;

executing a sound source direction decision process that includes comparing, for each of the frames and for each of frequency bands having the width, first power of a frequency component, which is included in the frequency band of one of the first frequency spectrum and the second frequency spectrum, of sound coming from a first direction and second power of a frequency component, which is included in the frequency band of one of the first frequency spectrum and the second frequency spectrum, of sound coming from a second direction different from the first direction with each other;

executing a gain setting process that includes setting a gain according to a result of the comparison for each of the frames and for each of the frequency bands;

executing a correction process that includes calculating, for each of the frames and for each of the frequency bands, a frequency spectrum corrected by multiplying a frequency component included in the frequency band of one of the first frequency spectrum and the second frequency spectrum by the gain set for the frequency band; and executing a frequency time conversion process that includes generating a directional sound signal by frequency time converting the corrected frequency spectrum for each of the frames.

12. The non-transitory computer-readable storage medium according to claim 11, wherein the bandwidth controlling process is configured to increase the width of the frequency band as the power of noise increases.

13. The non-transitory computer-readable storage medium according to claim 11, wherein the bandwidth controlling process is configured to increase the width of the frequency band as the signal to noise ratio decreases.

14. The non-transitory computer-readable storage medium according to claim 11, wherein the noise level evaluation process is configured to calculate, for each of the frames, the one of the power of noise and the signal to noise ratio in regard to each of a plurality of fixed frequency bands having a fixed width set in advance; and the bandwidth controlling process is configured to set the width in regard to each of the fixed frequency bands such that the width is equal to or smaller than the fixed width in response to the one of the power of noise and the signal to noise ratio.

15. The non-transitory computer-readable storage medium according to claim 11, wherein the noise level evaluation process is configured to calculate the power of noise as the one and calculate an average value of the power of noise over the plurality of frames; and the bandwidth controlling process is configured to set, to the same power of noise, the width so as to decrease as the average value of the power of noise increases.

* * * * *